US005603135A

United States Patent [19]

Jones et al.

[11] Patent Number: 5,603,135

[45] Date of Patent: Feb. 18, 1997

[54] POOL CLEANER WITH REPLACEABLE MAST

[75] Inventors: Robert E. Jones; Sanford F. Campbell, both of Redding, Calif.

[73] Assignee: Letro Products, Inc., Redding, Calif.

[21] Appl. No.: 550,949

[22] Filed: Oct. 31, 1995

[51] Int. Cl.[6] ..... E04H 4/16

[52] U.S. Cl. ..... 15/1.7; 285/376

[58] Field of Search ..... 15/1.7; 285/376, 285/211, 204, 189; 403/349, 238, 350; 210/169

[56] References Cited

U.S. PATENT DOCUMENTS 3,822,754 7/1974 Henkin et al. ..... 15/1.7

4,558,479 12/1985 Greskovics et al. ..... 15/1.7

*Primary Examiner*—David Scherbel
*Assistant Examiner*—Tony G. Soohoo
*Attorney, Agent, or Firm*—Keith A. Newburry; Pretty, Schroeder, Brueggemann & Clark

[57] ABSTRACT

An improved automatic pool cleaner of the type having a frame and a supply mast fastened thereto at a lower end, in which a first fastener portion located adjacent to the lower end of the supply mast is removably engageable with a second fastener portion located on the frame. Because the first fastener portion is removably engageable with the second fastener portion, a broken supply mast can be easily separated from the frame and a new supply mast easily installed thereon.

23 Claims, 3 Drawing Sheets

30
24
26
28
20
4
46
22
44
4
18
14
18
18
10
16
12

POOL CLEANER WITH REPLACEABLE MAST

BACKGROUND OF THE INVENTION

The present invention relates to an improvement for a mechanical pool cleaner of the type commonly used for removing small items of debris such as dirt, sand or leaves from swimming pools. More particularly, the invention provides an apparatus and method for easily repairing and replacing a supply mast on such a pool cleaner.

A swimming pool provides many benefits. Chief among such benefits are recreational and competitive swimming, which are enjoyed by people all over the world. Swimming is an excellent exercise that yields generally improved health, overall fitness, body toning and cardiovascular improvements. For many people, a swimming pool also provides a welcome relief from hot weather. Additionally, swimming pools and other decorative pools provide aesthetic benefits that can substantially enhance the attractiveness and value of the surrounding property. Decorative pools are used as landscaping features on private, public, and commercial properties. Considering such benefits, it is not surprising that countless swimming pools of widely varying size and design are in place at parks, recreational facilities, schools, and homes.

For all their benefits, pools can be difficult and time consuming to maintain because dirt, sand and other debris invariably find their way into the pool. In outdoor settings, leaves, lawn clippings, and other plant materials are carried or blown into the pool. This debris settles onto the bottom or walls of the pool, where it accumulates until it is removed. A dirty pool is unsightly and can be unsanitary as well. For this reason, much effort is expended in keeping a pool clean. Especially for a homeowner or apartment manager, this continuing cleaning effort can substantially detract from the benefits of pool ownership.

A range of devices is available to assist in removing debris from pools. One such device is a well known simple tool having a mesh or net suspended in a frame at the end of a long pole. This tool is used to manually sweep or skim debris from the pool. Although it is inexpensive and simple to operate, cleaning a pool with this tool is laborious and cumbersome. Accordingly, this tool is generally used for spot cleaning rather than routine, continuous debris removal.

Manual pool cleaners also are well known devices suitable for cleaning swimming pools. A simple manual pool cleaner features a vacuum head mounted at one end of a long pole. The vacuum head draws water and debris from the bottom or sides of a pool in much the same way that a common household vacuum cleaner removes debris from floors. Although such a manual pool cleaner is generally effective in removing debris from a pool, a human operator is required for its operation.

To reduce the need for a human operator, automatic pool cleaners have been developed. One conventional automatic pool cleaner has a wheeled carriage equipped with a suction tube for drawing debris from the bottom of the pool into a mesh debris bag. This cleaner also has a tubular supply mast projecting upward from a frame inside the wheeled carriage to connect to a pressurized water feed line that powers the suction tube and also moves the cleaner across the bottom and walls of the pool along a more or less random path. The supply mast can be either integrally formed into the frame or can be a separate piece glued to the frame or can be fastened to the suction tube with the awkward use of three small screws. The supply mast also has a horizontal projection upon which a ballast float can be mounted to balance the cleaner. As the cleaner moves over the pool bottom, items of debris are picked up and removed from the pool as the suction tube draws pool water into the device.

While this cleaner is generally effective in automatically cleaning pools, the supply mast can break, thereby necessitating costly repair of the cleaner. Such supply mast breakage is caused by a number of factors. Harsh chemicals in the pool water and radiation from the sun can attack and weaken the material of the supply mast, which is typically made of plastic. In addition to the weakening of the supply mast itself, a number of everyday events occur that place stress upon the supply mast. For example, because the cleaner's supply mast essentially drags the feed hose around the pool, the feed hose continuously subjects the supply mast to stress when the cleaner is moving. Further, because users can pick up the cleaner by the feed line, ballast float or the supply mast itself, the supply mast can be subjected to stresses which can cause breakage. Finally, when the cleaner is out of the pool, it may be susceptible to impact which also can fracture the supply mast.

When the supply mast breaks, a costly and laborious procedure must be undertaken to replace the supply mast and place the cleaner in an operable condition. Supply masts that are glued to or integrally formed with the frame cannot be readily removed and replaced. Usually, to fix such a supply mast a repair technician cuts away the broken portion of the supply mast with a hacksaw or similar cutting tool. After removal of the broken portion, the technician must obtain a new supply mast piece sized to fit on the unbroken portion of the supply mast. The technician then glues the new supply mast piece onto the unbroken supply mast portion, resulting in a supply mast with the same basic dimensions as the original. While this technique is generally effective, it is laborious and expensive because it requires trained personnel.

Although cleaners are known to have removable supply masts, they are fastened to the suction tube by screws that are small and difficult to handle. In particular, these screws can be dropped into the inner workings of the cleaner and lost. Further, because the supply mast screws engage the suction tube instead of the frame, the connection between the lower end of the supply mast and the frame is not as secure as it could be, thereby potentially allowing leakage of the feed water and reducing the power available to the cleaner. Further, the interconnection of the supply mast, suction tube and frame requires higher and therefore more expressive manufacturing tolerances.

Accordingly, there exists a need for an automatic pool cleaner that has an easily installable and replaceable supply mast that is securely mounted to the frame. The present invention fulfills this need.

SUMMARY OF THE INVENTION

Briefly, and in general terms, the present invention resides in an improvement in an automatic pool cleaner which allows for the easy and secure installation, removal and replacement of a supply mast relative to a cleaner frame. The improvement comprises a supply mast and cleaner frame having mating and mechanically interlocking fastener portions that are adapted for manual assembly and disassembly. This arrangement not only facilitates manufacture of the pool cleaner and provides a secure mast to frame connection, but allows for field replacement of broken supply masts without the need for a trained technician.

More specifically, the improvement includes apparatus and a method wherein the lower end of the supply mast has one or more projections which are adapted to be matingly received within a like number of corresponding arcuate slotted openings defined in the cleaner frame, surrounding a central passageway for water flow. The projections are shaped to interlock with the openings. After the projections are received in the openings, the supply mast is then twisted and locked in place to securely fasten it to the cleaner frame. By reverse twist, the supply mast can be readily removed for replacement.

In a presently preferred embodiment of the invention, at least three projections are provided, each of which is L-shaped. The free ends of the projections may be slightly tapered or beveled to facilitate engagement with the cleaner frame surrounding the slotted openings, while the opposite ends of the projections are preferably sized for an interference fit with the cleaner frame as the supply mast is twisted into its fully engaged and locked position. The projections may be formed as part of an enlarged base at the lower end of the supply mast to provide enhanced stability. A seal may be provided between the lower end of the supply mast and the cleaner frame to ensure a watertight connection therebetween.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The following drawings illustrate various embodiments of the invention, in which.

DETAILED DESCRIPTION OF THE PREFERRED EMBODIMENT

Figure 1:
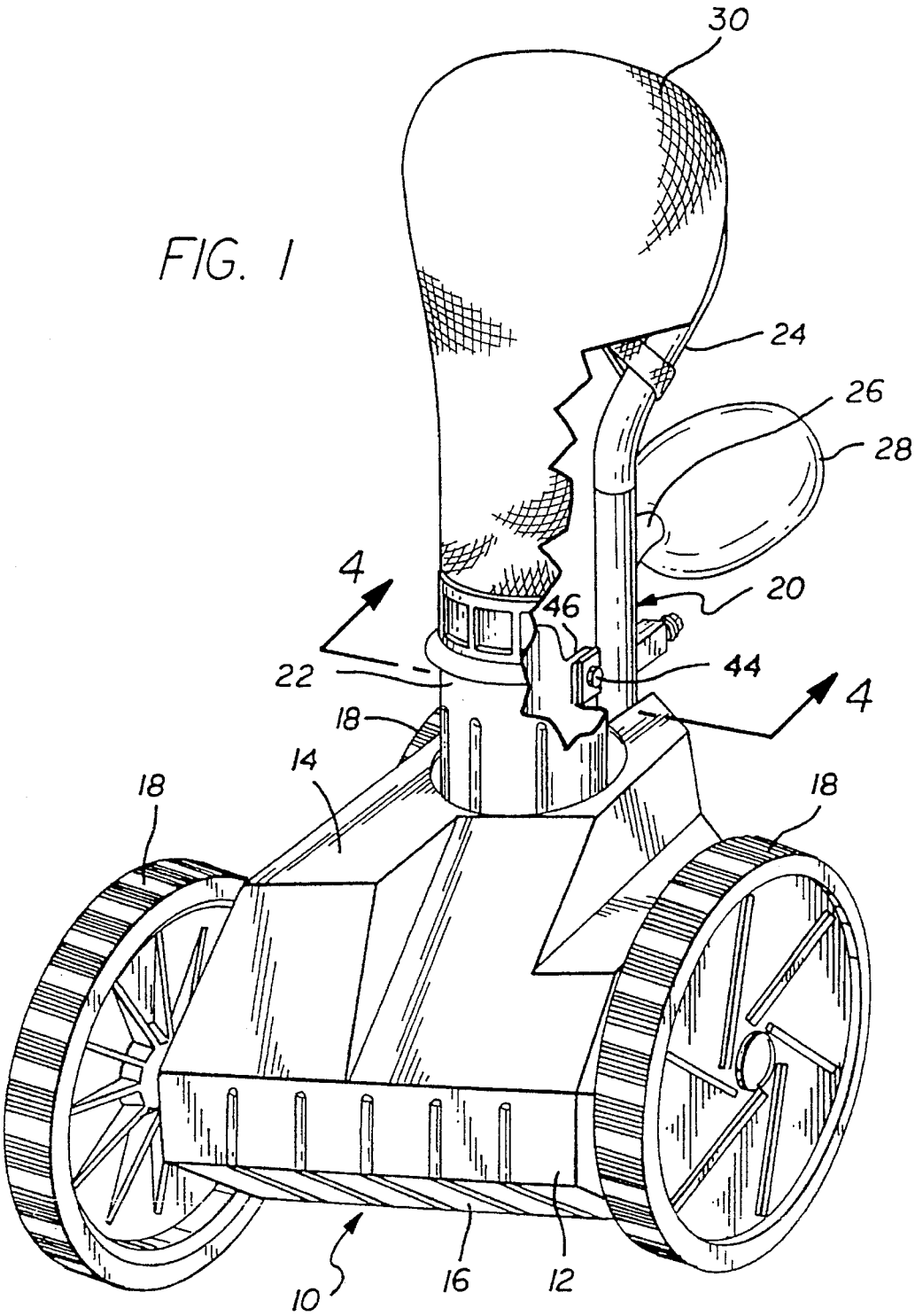
FIG. 1 is a perspective view of an automatic pool cleaner in accordance with the present invention.

Referring now to the drawings, and particularly FIG. 1 thereof, the present invention is embodied in an improved automatic pool cleaner generally referred to by the reference numeral 10. The improved pool cleaner has a central frame 12 sandwiched between an upper body shell 14 and a lower body shell 16. Three wheels 18 are mounted to the frame 12 to allow the cleaner 10 to roll across the bottom and sides of a swimming pool (not shown). A supply mast 20 and a suction tube 22 extend upwardly from the frame and through the upper body shell 14. The supply mast 20 is connected to a pressurized water feed line 24 that powers the cleaner, as is well known in the art. The supply mast has a horizontal support 26 extending toward the rear to hold a ballast float 28. The bottom of the supply mast is removably connected to the frame 12, as will be described in more detail below. As is also well known in the art, some of the pressurized water from the feed line 24 is injected upward into the suction tube 22 to create a venturi that suctions debris from under the cleaner up into a debris bag 30 mounted on the top of the venturi tube 22.

Figures 2, 5:
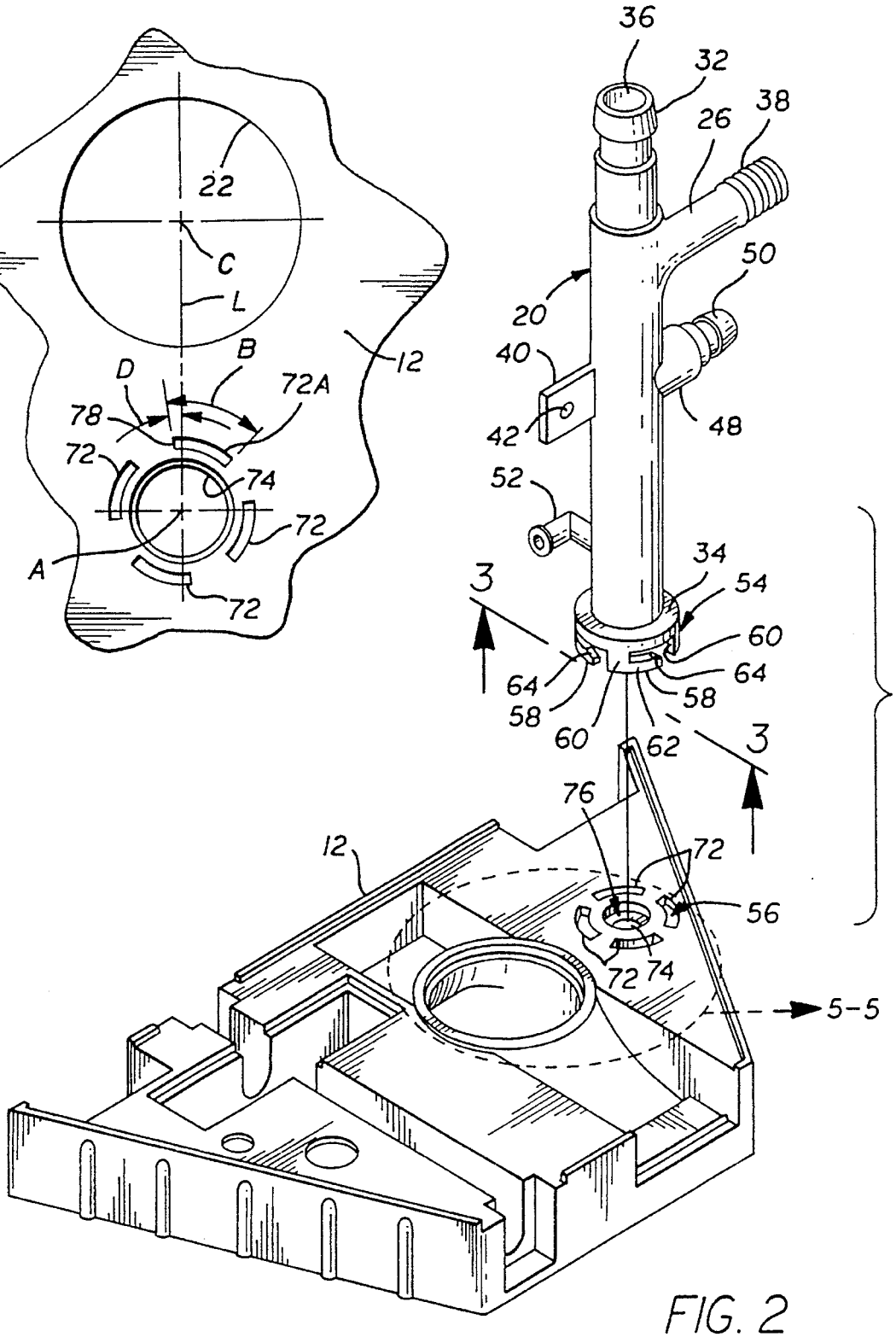
FIG. 2 is an exploded perspective view of a frame and a supply mast from the automatic pool cleaner shown in FIG. 1.
FIG. 5 is a schematic top plan view of the frame about line 5—5 of FIG. 2.

As shown in FIG. 2, the supply mast 20 is removably mounted to the frame 12 to allow for easy assembly and disassembly for the replacement of the supply mast. The supply mast 20 has a tapered upper end 32, an enlarged lower end 34, and a cylindrical interior surface 36 defining a passage between an opening in the upper end 32 and an opening in the lower end 34. The internal passage allows pressurized feed water to flow from the feed line 24, through the supply mast 20 and into the cleaner. The supply mast's horizontal support 26 has external threads 38 to engage the ballast float 28. At approximately the mid-portion of the supply mast, a support tab 40 projects horizontally in a forward direction. The support tab has a hole 42 sized to accommodate a medium sized, easy to handle stainless steel nut and bolt 44 that attaches the tab to a corresponding tab 46 on the rear side of the suction tube (see FIG. 1). On the rearward side of the supply mast 20, a sweep hose feed tube 48 projects horizontally rearward. The feed tube has a tapered end 50 to allow for the attachment of a sweep hose (not shown), as is well known in the industry. The feed tube 48 has an interior passage that intersects with the interior passage of the supply mast to divert some of the feed water to move the sweep hose, as is well known in the art. Lower down, the supply mast 20 has an angled feed tube 52 to divert some of the feed water from the interior passage of the supply mast to spin a turbine (not shown) and power the movement of the cleaner 10, as is also well known in the art. Finally, the lower end 34 of the supply mast features a first fastener portion 54 that removably engages a second fastener portion 56 on the frame to allow easy removal and replacement of the supply mast 20.

Figure 3:
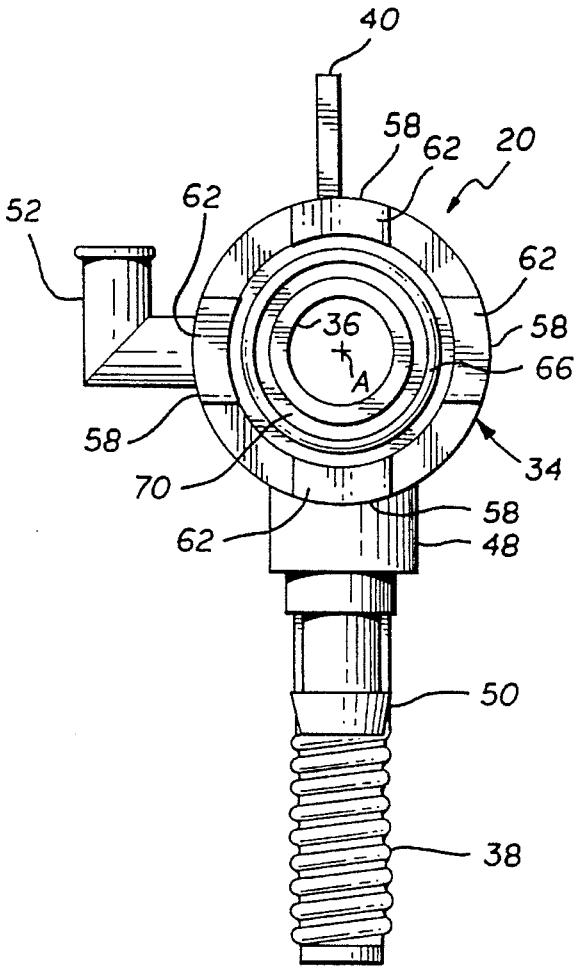
FIG. 3 is a bottom plan view of the supply mast, taken from line 3—3 of FIG. 2.
Figure 4:
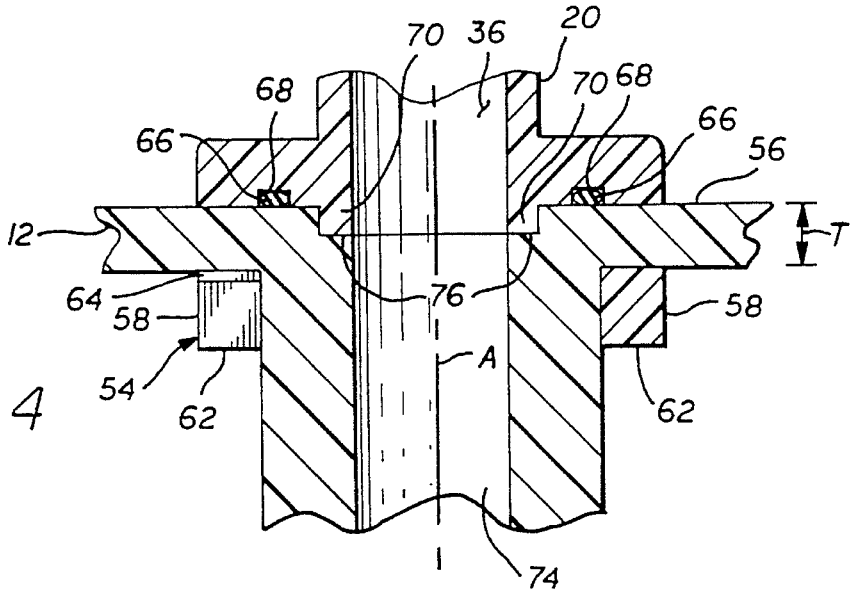
FIG. 4 is a cross sectional view showing the supply mast connected to the frame of the automatic pool cleaner shown in FIG. 1.

As shown in FIGS. 2, 3 and 4, the first fastener portion 54 on the lower end 34 of the supply mast 20 has four L-shaped projections 58. Each projection 58 has a vertical leg 60 extending downwardly from the lower end 34 of the supply mast 20 to a horizontal end piece 62, to define the L shape. A bevel 64 is formed on the upper side of each horizontal end piece 62. The bevel allows easy engagement of the second fastener portion 54, as will be described below. As viewed from below (FIG. 3), the projections 58 have arcuate profiles that cooperatively define a circle concentrically located about the axis A of the supply mast's interior passage 36.

Now referring to FIG. 4 for the finer detail of the supply mast 20, an elastomeric O-ring 66 is located in a circular slot 68 formed radially inwardly from the projections 58 and located concentrically about the axis A of the supply mast's interior passage 36. A cylindrical wall 70 is concentrically located radially inwardly from the slot 68 and defines the opening to the supply mast's interior passage 36.

FIGS. 2 and 4 show the first fastener portion 54 of the supply mast engaging the second fastener portion 56, which is preferably integrally formed in the frame 12. The second fastener portion 56 has four arcuate openings 72 cooperatively defining a circle concentrically located about an interior passage 74 in the frame 12. The interior passage of the frame has an axis aligned with axis A of the supply mast's interior passage 36. The opening of the frame's interior passage 74 is located to engage the opening in the lower end 34 of the supply mast 20. The arcuate openings 72 are sized to accept the L-shaped projections 58 on the lower end 34 of the supply mast 20. The thickness of the frame material located in between the arcuate openings 72 is sized to fit snugly between the upper sides of the horizontal end pieces 62 of the supply mast's L-shaped projections 58 and the lower end 34 of the supply mast. Such a snug fit draws the O-ring 66 into contact with the frame 12 to provide a seal between the supply mast 20 and the frame 12. A cup-shaped depression 76 is formed around the opening to the frame's interior passage 74. This cup-shaped depression 76 is sized to accommodate the cylindrical wall 70 on the lower end 34 of the supply mast 20.

Referring now to FIG. 5, as viewed from above, it can be seen that each arcuate opening 72 in the frame 12 is preferably located along a fifty-six degree (56°) arc B and that the arcuate openings are evenly distributed about the axis A of the interior passage 74 in the frame 12. The suction tube 22 has a center point C located directly forward of the axis A. The arcuate opening 72A between the frame's passage 74 and venturi tube has an edge 78 located two degrees (2°) counterclockwise (see angle D) from a line L drawn between the centerpoint C of the suction tube 22 and axis A located at the frame'interior passage 74. This two degree offset allows the supply mast 20 to rotate into a position wherein its support tab 40 is adjacent to the corresponding tab 46 on the rear of the suction tube 22. Of course, the orientation and size of the arcuate openings 72 in the frame 12 will vary with the dimensions of the projections and the support tab on the supply mast. Both the supply mast 20 and the frame 12 can be made from white colored U.V. stabilized ABS plastic, or other suitable material, by commonly known injection molding processes.

The supply mast 20 can be readily attached and removed from the frame 12 without the cutting and gluing operation required by conventional cleaners. Specifically, to attach the supply mast 20 to the frame 12, the supply mast is positioned so that the L-shaped projections 58 are in opposed alignment with the arcuate openings 72 in the frame 12 and the supply mast's support tab 40 is spaced clockwise from the support tab 46 on the suction tube 22. The supply mast is then lowered to allow the horizontal end pieces 62 of the projections 58 to pass through the arcuate openings 72. In this intermediate position, the bevels 64 on the upper ends of the horizontal end pieces are adjacent to the lower edges of the arcuate openings 72. Accordingly, when the supply mast is rotated counterclockwise, the bevels engage the frame material between the arcuate openings to cause the supply mast 20 to be snugly drawn up against the frame 12. The supply mast 20 is rotated until the vertical legs 60 of the projections hit the edges of the arcuate openings. At this point, the supply mast is attached to the frame 12 and the O-ring 66 seals the connection between the interior passage of the supply mast 36 and the interior passage 74 of the frame. Finally, the easy to handle stainless steel nut and bolt 44 are installed to attach the supply mast's support tab 40 to that of the suction tube 22 to hold the supply mast in position with respect to the frame 12. If the supply mast 20 is broken or otherwise requires replacement, the above-identified process can be reversed to remove the supply mast, and a new supply mast can be easily installed. Such easy installation of the supply mast on the frame also advantageously saves costly labor during the manufacturing of the pool cleaner.

It will, of course, be understood that modifications to the presently preferred embodiment will be apparent to those skilled in the art. Consequently, the scope of the present invention should not be limited by the particular embodiment discussed above, but should be defined only by the claims set forth below and equivalents thereof.

What is claimed is:

1. In an automatic pool cleaner having a frame and a supply mast fastened thereto at a lower end, the improvement comprising a first fastener portion adjacent to the lower end of the supply mast and a second fastener portion on the frame, the first fastener portion removably engageable with the second fastener portion for removably attaching the supply mast to the frame, wherein the first fastener portion comprises a projection extending from the lower end of the supply mast, and the second fastener portion defines an opening located on the frame sized to removably engage the projection to removably attach the lower end of the supply mast to the frame.

2. The automatic pool cleaner of claim 1, wherein the projection is generally L-shaped and sized to engage the opening of the second fastener portion.

3. The automatic pool cleaner of claim 2, wherein a bevel is formed on each projection.

4. The automatic pool cleaner of claim 1, wherein the opening has an arcuate shape.

5. The automatic pool cleaner of claim 1, further comprising:

an interior surface within the supply mast, the interior surface defining a fluid pathway from an upper opening to a lower opening, the upper opening for connection to a pressurized water feed line, the lower opening located at the lower end of the supply mast;

an opening defined by the frame, the opening located in opposed alignment with the opening in the lower end of the supply mast to receive pressurized feed water therefrom; and a seal mounted about the lower opening in the supply mast to engage the frame to prevent leakage of fluid passing from the lower opening of the supply mast to the opening in the frame.

6. The automatic pool cleaner of claim 1, wherein the first fastener portion comprises a plurality of projections extending from the lower end of the supply mast, the additional projections located to engage the second fastener portion.

7. The automatic pool cleaner of claim 6, wherein a bevel is formed on each projection.

8. The automatic pool cleaner of claim 6, wherein the second fastener portion defines a plurality of openings located on the frame, each opening in opposed alignment with an associated one of the projections and sized to removably engage its associated projection.

9. The automatic pool cleaner of claim 8, wherein the first fastener portion includes at least three projections and the second fastener portion includes at least three corresponding openings.

10. The automatic pool cleaner of claim 8, wherein each projection is L-shaped.

11. The automatic pool cleaner of claim 8, wherein each opening has an arcuate shape.

12. In an automatic pool cleaner of the type having a wheeled frame connected to a lower end of a supply mast, the cleaner for traveling upon and cleaning submerged surfaces of a pool by a combination of jet action and vacuuming, the improvement comprising:

a first fastener portion adjacent to the lower end of the supply mast and a second fastener portion on the frame, the first fastener portion removably engageable with the second fastener portion to removably attach the supply mast to the frame, wherein the first fastener portion comprises a projection extending from the lower end of the supply mast, and the second fastener portion comprises an opening located on the frame and sized to removably engage the projection.

13. The automatic pool cleaner of claim 12, wherein the projection is generally L-shaped and sized to engage the opening of the second fastener portion.

14. The automatic pool cleaner of claim 12, wherein a bevel is formed on each projection.

15. The automatic pool cleaner of claim 12, wherein the opening has an arcuate shape.

16. The automatic pool cleaner of claim 12, wherein a ballast float is mounted to the supply mast.

17. The automatic pool cleaner of claim 12, further comprising:

an interior surface within the supply mast, the interior surface defining a fluid pathway from an upper opening to a lower opening, the upper opening for connection to a pressurized water feed line, the lower opening located at the lower end of the supply mast;

an opening defined by the frame, the opening located in opposed alignment with the opening in the lower end of the supply mast to receive pressurized feed water therefrom; and a seal mounted about the lower opening in the supply mast to engage the frame to prevent leakage of fluid passing from the lower opening of the supply mast to the opening in the frame.

18. The automatic pool cleaner of claim 12, wherein the first fastener portion comprises four projections extending from the lower end of the supply mast, and the second fastener portion defines four more openings, each located in opposed alignment with an associated projection of the second fastener portion.

19. The automatic pool cleaner of claim 18, wherein each projection is generally L-shaped and is sized to removably engage its associated opening.

20. The automatic pool cleaner of claim 19, wherein each opening has an arcuate shape.

21. The automatic pool cleaner of claim 19, wherein a bevel is formed on each projection.

22. In an automatic pool cleaner of the type having a wheeled frame connected to a lower end of a supply mast with a ballast float and a pressurized fluid feed line mounted thereto, the cleaner for traveling upon and cleaning submerged surfaces of a pool by a combination of jet action and vacuuming, the improvement comprising:

four L-shaped projections on to the lower end of the supply mast and four arcuate openings in the frame, each opening located to engage an associated one of the projections to removably attach the supply mast to the frame;

a bevel formed in each projection;

an interior surface in the supply mast, the interior surface defining a fluid pathway from an upper opening in the supply mast to a lower opening in the supply mast, the upper opening for connection to a pressurized fluid feed line, the lower opening located at the lower end of the supply mast;

an opening defined by the frame, the opening located in opposed alignment with the opening in the lower end of the supply mast to receive feed water therefrom; and a seal mounted about the lower opening in the supply mast to abut the frame and prevent leakage between the supply mast and the frame.

23. In an automatic pool cleaner of the type for traveling upon and cleaning submerged surfaces of a pool by a combination of jet action and vacuuming, the improvement comprising:

a wheeled frame;

a supply mast having a lower end and an upper end for connection to a pressurized water feed line;

a fastening means for removably mounting the lower end of the supply mast to the frame, the fastening means located adjacent to the lower end of the supply mast and the frame, wherein the fastening means comprises a projection extending from the lower end of the supply mast and an opening located on the frame and sized to removably engage the projection, the projection being removably engageable with the opening to removably attach the supply mast to the frame.

* * * * *